US005692680A

United States Patent [19]

Harwath et al.

[11] Patent Number: 5,692,680

[45] Date of Patent: Dec. 2, 1997

[54] FUEL SUPPLY UNIT FOR AN OIL BURNER

[75] Inventors: Frank L. Harwath; Dale L. Hunsberger, both of Rockford, Ill.

[73] Assignee: Suntec Industries Incorporated, Rockford, Ill.

[21] Appl. No.: 405,837

[22] Filed: Mar. 17, 1995

[51] Int. Cl.[6] ..... B05B 9/00

[52] U.S. Cl. ..... 239/127; 417/299; 137/117

[58] Field of Search ..... 239/124–127; 417/299, 310, 366; 418/170, 183; 137/117, 108

[56] References Cited

U.S. PATENT DOCUMENTS 4,255,093 3/1981 Erikson ..... 417/310

5,145,328 9/1992 Harwath ..... 417/299

*Primary Examiner*—Lesley D. Morris

*Attorney, Agent, or Firm*—Leydig, Voit & Mayer, LTD.

[57] ABSTRACT

A fuel supply unit adapted to supply a relatively constant flow of fuel oil to an oil burner independently of the pressure of the fuel at a discharge port. The fuel supply unit includes a pump which draws fuel oil from a storage tank and which supplies pressurized fuel to an outlet chamber. The fuel then flows from the outlet chamber to the burner by way of the discharge port. A metering orifice is located between the outlet chamber and the discharge port to control the flow rate of the fuel delivered to the burner, the volumetric flow rate of fuel being related to the pressure differential across the metering orifice. A regulating valve senses the pressure of the fuel at the discharge port and adjusts the pressure of the fuel in the outlet chamber to maintain a relatively constant pressure differential across the metering orifice.

8 Claims, 1 Drawing Sheet

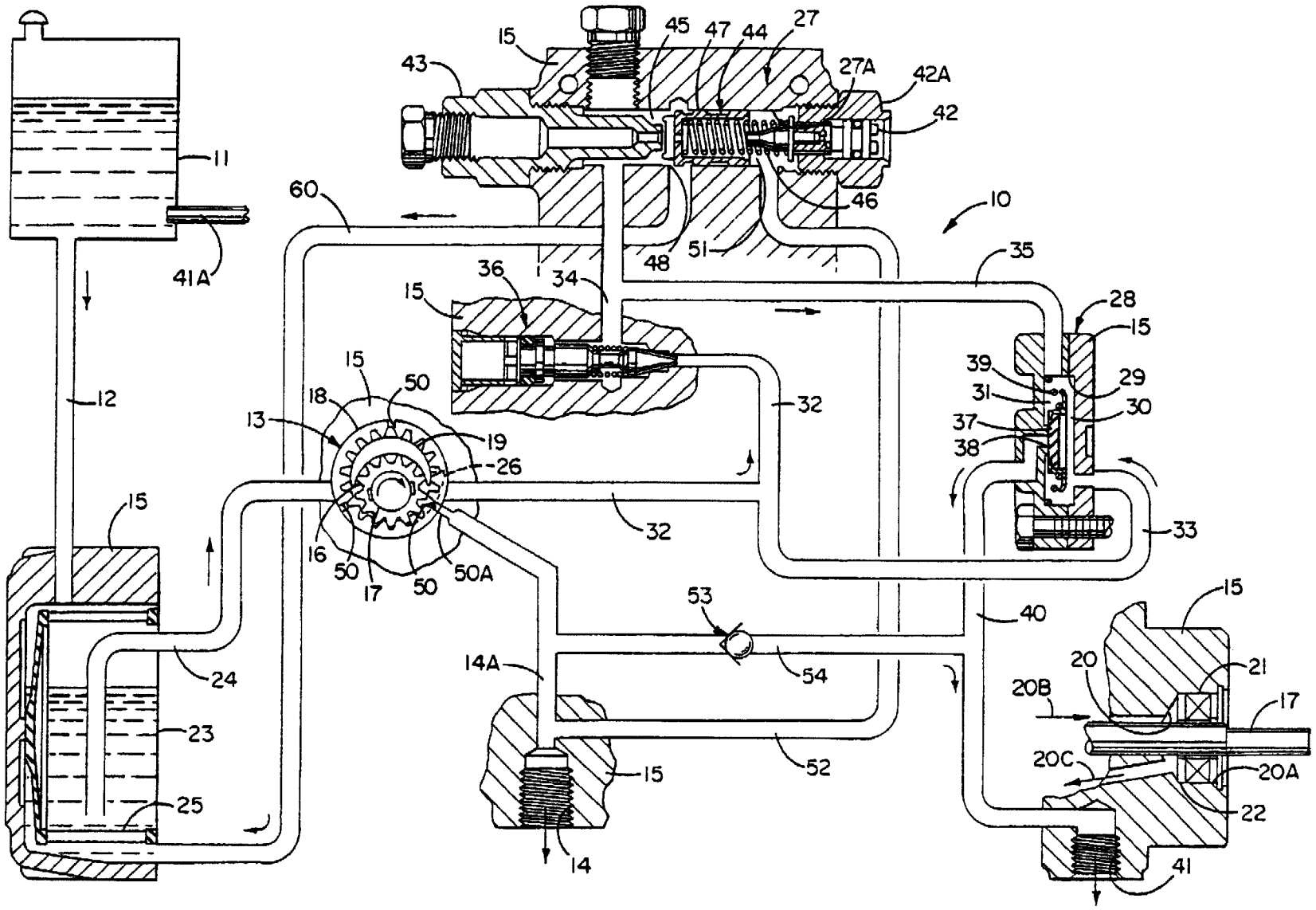
10
11
12
13
14
14A
15
16
17
18
19
20
20A
20B
20C
21
22
23
24
25
26
27
27A
28
29
30
31
32
33
34
35
36
37
38
39
40
41
41A
42
42A
43
44
45
46
47
48
50
50A
51
52
53
54
60

FUEL SUPPLY UNIT FOR AN OIL BURNER

BACKGROUND OF THE INVENTION

This invention relates generally to a fuel supply unit for supplying fuel oil to an oil burner. More particularly, the invention relates to a fuel supply unit of the type adapted to provide a predetermined and relatively constant volumetric flow rate, i.e., a metered flow, of fuel to the burner. A representative fuel supply unit or metering pump of this general type is disclosed in Erickson U.S. Pat. No. 4,255,093.

In a fuel supply unit of this type, a pump draws unpressurized fuel from a tank and delivers pressurized fuel to an outlet chamber. The fuel then flows from the outlet chamber to the burner by way of a nozzle port. The volumetric flow rate of the fuel delivered to the burner is determined by several parameters.

The pump is typically a rotary gear pump having an inner spur gear and an outer ring gear. Radially extending metering orifices are formed through the outer ring gear to intermittently establish communication between the outlet chamber and a timing port which communicates with the nozzle port. As the ring gear rotates, each orifice, in turn, briefly aligns with and then rotates past the timing port. Fuel flows from the outlet chamber during the short time in which each metering orifice is aligned with the timing port. This intermittent discharge from the outlet chamber smooths into a continuous flow of fuel to the burner at the normal operating speed of the gear pump. The volumetric flow rate of the fuel, then, is determined in part by the cumulative time in each revolution of the outer ring gear during which a metering orifice is aligned with the timing port. As a result, the flow rate can be varied by changing the size of the timing port and the size and number of metering orifices. Additionally, while a metering orifice is aligned with the timing port, the volumetric flow rate through that orifice is related to the difference between the pressure of the fuel in the outlet chamber and the pressure of the fuel at the nozzle port, i.e., the pressure differential across the orifice.

Prior fuel supply units typically control the fuel flow rate by including a regulating valve for regulating the pressure of the fuel in the outlet chamber to a predetermined value. A constant pressure in the outlet chamber will result in a constant flow rate through the metering orifice, provided that the pressure at the nozzle port remains constant.

The pressure at the nozzle port, however, is determined by the elevation of the burner with respect to the pumping unit. If the burner and the pumping unit are at or near the same elevation, the discharge pressure from the nozzle port will be at or very near atmospheric pressure. Alternately, if the burner is located above the pumping unit, a static pressure head or discharge pressure will develop at the nozzle port as a result of pumping the fuel upwardly to the burner. Under these conditions, for a predetermined pressure in the outlet chamber, the fuel flow to the burner will decrease in relation to the decrease in the pressure differential across the metering orifice. Moreover, some prior fuel supply units reference the regulating valve to the line between the tank and the pump. As a result, the regulated pressure in the outlet chamber and, therefore, the flow of fuel through the metering orifice is dependent on the elevation of the tank relative to the pump.

A prior fuel supply unit can be calibrated to achieve a desired fuel flow rate for a known discharge pressure by adjusting the regulated pressure in the outlet chamber. However, if the discharge pressure is higher than initially anticipated, of if the elevation of the tank is lower than initially anticipated, the reduced pressure differential across the orifice will result in reduced fuel delivery to the burner and a reduction in burner performance.

SUMMARY OF THE INVENTION

The general aim of the present invention is to provide a new and improved fuel pumping unit which is capable of supplying a constant flow of fuel to a burner independently of the elevation of the burner and the elevation of the tank with respect to the pumping unit.

A more detailed objective is to achieve the foregoing by providing a pressure compensating circuit which compensates for a change in discharge pressure downstream of a metering orifice so as to maintain a constant pressure differential across the metering orifice.

A still more detailed objective of the invention is to provide a regulating valve having a force balancing valve member which senses the discharge pressure downstream of the metering orifice and responds to a change in the discharge pressure by changing the pressure upstream of the metering orifice by an equal value. To this end, the valve member is provided a first projected area over which a control pressure acts, the pressure upstream of the metering orifice being linearly related to the control pressure, and a second projected area over which the discharge pressure acts, the second projected area being equal to but facing oppositely of the first projected area so that a change in discharge pressure results in an equal change in control pressure.

The invention also resides in novel means for supplying a short burst of relatively high pressure fuel to the burner during each burner startup cycle in order to clean small orifices in the nozzle of the burner.

These and other objects and advantages of the invention will become more apparent from the following detailed description when taken in conjunction with the accompanying drawing.

BRIEF DESCRIPTION OF THE DRAWINGS

The single FIGURE of the drawing is a schematic representation of a new and improved fuel pumping unit incorporating the unique features of the present invention.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

As shown in the drawing for purposes of illustration, the invention is embodied in a fuel pumping unit 10 adapted to supply a metered or controlled flow of fuel to an oil burner (not shown) such as might be incorporated in a furnace or a boiler. In general, a supply of fuel oil is drawn from a source such as a fuel storage tank 11 through an intake line 12 by a pump 13. The fuel is then pressurized by the pump and is delivered to the burner by way of a discharge port or nozzle port 14.

The typical oil burner of the type adapted to receive a metered flow of fuel will include a shutoff valve between the nozzle port 14 and the burner nozzle. Provided the pumping unit 10 is operating, the shutoff valve enables the burner to be started or shutdown independently of the pumping unit. To insure that the nozzle receives the desired flow rate of fuel when the burner is started, the shutoff valve will be closed while the pump 13 is brought up to its normal operating speed. The shutoff valve is then opened and the metered flow of fuel is immediately available for ignition in the nozzle.

The pump 13 is a crescent-type rotary gear pump and includes an inner spur gear 16 mounted on a drive shaft 17. The inner gear is eccentrically disposed in an outer ring gear 18 which, in turn, is rotatably supported in a housing 15. The inner and outer gears are rotatably coupled by mating gear teeth and serve as the pumping elements to pressurize the fuel. A crescent shaped member 19 is disposed between the non-engaging portions of the gear teeth and seals between the expanding fluid chamber and the contracting fluid chamber defined by the rotating gears.

The drive shaft 17 is journaled in the housing 15 and extends through an opening 20A in the housing for coupling with, for example, an electric motor (not shown). A radial lip seal 21 closes a chamber 20 in the housing and seals between the housing and the drive shaft to prevent oil leakage from the opening 20A. During operation of the pumping unit 10, the pump 13 delivers a supply of oil to the chamber 20 as indicated at 20B for lubrication of the rotating shaft. The lubricating oil then returns directly to a reservoir 23 as indicated at 20C. A magnetic ring 22 is located adjacent to and internally of the lip seal to generally prevent magnetic contaminants in the oil from reaching the lip seal.

An inlet to the pump 13 communicates with the reservoir 23 by way of a passage 24. The reservoir is located internally in the pumping unit 10 and receives oil from the tank 11 through the intake line 12. A strainer 25 is located in the reservoir for filtering the oil received from the tank. An outlet chamber in the form of an outlet kidney 26 in the pump receives the pressurized fuel. Fuel is delivered from the outlet kidney to the nozzle port 14 by way of a discharge passage 14A. A portion of the pressurized fuel also flows from the outlet kidney to a regulating valve 27 and to a diaphragm valve 28.

The diaphragm valve 28 automatically purges the pumping unit 10 of air during startup of the pump 13. The diaphragm valve includes a resilient diaphragm 29 located within a chamber and dividing the chamber into a high pressure compartment 30 and a low pressure compartment 31. A valve member 37 is located in the low pressure compartment and is carried by the diaphragm 29. The valve member 37 is urged away from a valve port 38 by a spring 39 also located in the low pressure compartment. The valve port 38 communicates with a bypass port 41 by way of a bypass passage 40. The bypass port, in turn, is connected to the tank 11 as indicated at 41A for venting fuel from the low pressure compartment.

The high pressure compartment 30 communicates directly with the outlet kidney 26 by way of an outlet passage 32 and an additional passage 33. The high pressure compartment is dead-ended so that the pressure in the high pressure compartment is essentially the same as the pressure in the outlet kidney. Fuel flows from the outlet kidney to the low pressure compartment 31 by way of the outlet passage 32, a control passage 34, and an additional passage 35. A cone valve 36 is located between the outlet passage 32 and the control passage 35 to cause a drop in pressure as the fuel flows from the outlet passage to the control passage. The pressure drop across the cone valve results in a pressure differential between the high and low pressure compartments.

With the foregoing arrangement, the spring 39 normally holds the valve member 37 in an open position with respect to the valve port 38, the valve member 37 being operable to close the valve port 38 when the pressure differential between the high pressure compartment 30 and the low pressure compartment 31 is sufficient to overcome the force of the spring 39. During startup of the pump 13, when the pump speed is relatively low and the flow past the cone valve is relatively low, the valve port 38 remains open because the pressure differential acting on the diaphragm 29 is insufficient to overcome the force of the spring 39. Since the regulating valve 27 and the burner shutoff valve are normally closed during startup of the pump, fuel that initially flows through the pump is delivered to (1) the low pressure compartment 31 whereupon the fuel is vented through the valve port 38 and returned to the tank 11 and (2) the chamber 20 whereupon the fuel is returned to the reservoir 23. As a result, air is automatically purged from the pump before the pump reaches its normal operating speed. The diaphragm valve is a relatively quick-acting valve. Therefore, to maintain fuel in the return line between the valve port 38 and the tank 11 during normal operation of the pumping unit 10, the return line is sized to quickly fill with fuel after air has been purged from the pumping unit and before the diaphragm valve closes. For example, a relatively small diameter tube such as a capillary tube may be used for relatively long return lines.

When the pump 13 reaches a predetermined speed near its normal operating speed and the pressure in the outlet kidney reaches a predetermined value, the pressure differential acting on the diaphragm 29 is sufficient to overcome the force of the spring 39 and cause the valve member 37 to close the valve port 38. During normal operation of the pump, the valve port 38 remains closed.

In the event that the speed of the pump 13 drops below the predetermined speed, for example, during shutdown of the pump, the pressure differential acting on the diaphragm 29 is insufficient to hold the valve member 37 against the valve port 38. In this instance, the spring 39 moves the valve member 37 away from the valve port 38 and communication is reestablished between the low pressure compartment 31 and the valve port 38 to relieve the pressure in the pump.

At least one and preferably three angularly spaced metering orifices 50 are formed in the outer ring gear 18 to establish communication between the outlet kidney 26 and the discharge passage 14A for delivering fuel to the burner. Each orifice extends through the ring gear in a generally radial direction from the root between two adjacent teeth to the outer surface thereof. As the ring gear rotates, each orifice, in turn, briefly aligns with and then rotates past a timing port 50A formed at the upstream end of the discharge passage 14A to establish a pulsating discharge which smooths into a continuous flow of fuel at the normal operating speed of the pump 13.

For a predetermined speed of the pump 13, the volumetric flow rate of fuel delivered to the burner is related to the cumulative time in each revolution of the ring gear 18 during which an orifice 50 is aligned with the timing port 50A. The flow rate during the time each orifice is aligned with the timing port is related to the pressure differential across the orifice. As a result, the volumetric flow rate of fuel delivered to the burner is related to the difference between the pressure of the fuel in the outlet kidney 26 and the pressure of the fuel at the nozzle port 14.

The regulating valve 27 controls the pressure of the fuel in the outlet kidney 26. The regulating valve includes a hollow cylindrical valve member 44 slidably disposed in a cylindrical bore 27A and dividing the bore into a control chamber 45 and a reference chamber 51. Threaded into one end of the bore and closing off the control chamber is a fitting 43. The control chamber communicates with the outlet kidney 26 by way of the outlet passage 32 and the control passage 34.

A normally stationary adjusting screw 42 is threaded into a fitting 42A which, in turn, is threaded into the opposite end of the bore 27A. A helical compression spring 46 located in the reference chamber 51 is seated in the valve member 44 and engages the adjusting screw 42 to normally urge the valve member 44 against the end of the fitting 43. With the valve member 44 in this position, a radially outwardly extending land 47 formed on the valve member 44 cuts off communication between the control chamber 45 and a return port 48 formed in the bore. The return port is connected to the reservoir 23 by a return passage 60.

Pressure in the control chamber 45 acts on the valve member 44 over a first projected area equal to the cross-sectional area of the bore 27A. The force of this pressure opposes the force of the closing spring 46 and, during normal operation of the pumping unit 10, moves the valve member 44 to the right to establish communication between the control chamber and the return port 48. The valve member 44, in conjunction with the spring 46, then modulates the flow area at the return port 48 so as to maintain an equilibrium or regulated control pressure in the control chamber. This equilibrium pressure is set to a predetermined pressure during initial calibration of the pumping unit 10 by turning the adjusting screw 42 to change the force of the spring 46 acting on the valve member 44.

So long as the return port 48 is open, fuel continuously flows from the outlet kidney 26 to the control chamber 45 and is vented to the reservoir 23 for recirculation in the pumping unit 10. This continuous flow of fuel between the outlet kidney and the control chamber results in a relatively constant drop in pressure as the fuel flows past the cone valve 36. The constant pressure drop results in a linear relationship between the pressure in the control chamber and the pressure in the outlet kidney. As a result, a change in the pressure in the control chamber results in an equal change in pressure in the outlet kidney. Therefore, the regulating valve 27 controls the pressure in the outlet kidney by regulating the pressure in the control chamber.

A constant pressure in the outlet kidney 26 results in a constant flow rate through each metering orifice 50 provided the pressure at the nozzle port 14 remains constant. The pressure at the nozzle port, however, is determined by the elevation of the burner relative to the pumping unit. If the burner is located above the pumping unit, a static pressure head or discharge pressure will develop at the nozzle port as a result of pumping the fuel upwardly to the burner and the fuel flow rate will decrease in relation to the change in differential pressure across the orifice.

In accordance with one aspect of the present invention, the regulating valve 27 is adapted to compensate for a change in discharge pressure at the nozzle port 14 by adjusting the pressure in the outlet kidney 26 so as to maintain a relatively constant pressure differential across the metering orifices 50. As a result, the flow rate of fuel to the burner is relatively constant and is independent of the pressure of the fuel at the nozzle port 14.

In carrying out the invention, the reference chamber 51 communicates with the discharge passage 14A near the nozzle port 14 by way of a reference passage 52. The reference chamber is closed by the fitting 42A and the adjusting screw 42 so that the pressure in the reference chamber is equal to the pressure at the nozzle port.

The regulating valve 27 is typically calibrated to establish a predetermined equilibrium pressure in the control chamber 45 when the nozzle port 14 is at atmospheric pressure. The presence of gage pressure in the reference chamber 51, i.e., the presence of discharge pressure at the nozzle port, affects the force balance on the valve member 44 and, therefore, affects the equilibrium pressure in the control chamber. Specifically, pressure in the reference chamber results in an additional force acting on the valve member 44 in the same direction as the closing spring 46 and oppositely of the pressure in the control chamber. The valve member 44 responds to this additional force by moving to the left, reducing the flow area at the return port 48 and causing the pressure in the control chamber to increase. This action continues until the oppositely directed forces acting on the valve member are again balanced. As a result, the regulated pressure in the control chamber 45 increases to offset the additional force on the valve member 44 due to the presence of discharge pressure at the nozzle port 14. Similarly, a decrease in pressure at the nozzle port results in a decrease in pressure in the control chamber.

Advantageously, the pressure in the reference chamber 51 acts on the valve member 44 over a second projected area approximately equal to but facing oppositely of the projected area over which the pressure in the control chamber 45 acts. Therefore, absent consideration of errors due to, for example, the flow forces at the return port 48, and the sliding friction between the valve member and the bore 27A, a change in pressure in the reference chamber will result in an equal change in pressure in the control chamber. As previously discussed, a change in pressure in the control chamber, in turn, results in an equal change in pressure in the outlet kidney 26. Advantageously, the regulating valve 27 does not communicate with the intake line 12. As a result, the difference in pressure between the outlet kidney and the nozzle port 14 remains unchanged regardless of the pressure in the intake line and regardless of the discharge pressure at the nozzle port.

Further in accordance with the present invention, the pumping unit 10 provides for a short burst of relatively high pressure fuel during each startup cycle of the burner. This burst of fuel enables cleaning of relatively small orifices in the burner nozzle. For this purpose, a check valve 53 allows the fuel at the nozzle port 14 to build to a predetermined maximum pressure referenced to the elevation of the tank 11 when the shutoff valve on the burner is closed.

More specifically, the check valve 53 is located in a passage 54 connecting the discharge passage 14A and the bypass passage 40. The inlet of the check valve communicates with the discharge passage. The outlet of the check valve communicates with the bypass passage which, in turn, communicates with the tank 11. The check valve is calibrated to open when the pressure differential across the check valve approaches the predetermined maximum pressure. The resulting pressure in the discharge passage is safely above the maximum discharge pressure that will normally be encountered by the pumping unit 10 as a result of the difference in elevation between the pumping unit and the burner. In addition, this maximum pressure will only be encountered when the pump 13 is running at its normal operating speed and the shutoff valve on the burner is closed. As a result, the check valve is normally closed and opens to establish one-way communication from the discharge passage to the bypass passage when the burner shutoff valve is closed. After opening, the check valve regulates or maintains the pressure at the nozzle port 14 below the predetermined maximum pressure by venting fuel from the discharge passage.

With the foregoing arrangement, a short burst of relatively high pressure fuel is delivered to the nozzle when the shutoff valve is opened. This short burst of fuel blows out the contamination that may have collected in relatively small orifices in the nozzle during the time when the burner was shut down. Cleaning these orifices will permit the metered fuel flow to enter the nozzle and will preclude a buildup of discharge pressure due to a restricted flow path in the nozzle. The pressure at the nozzle port then quickly drops and the check valve closes to prevent further communication between the discharge passage 14A and the bypass passage 40 during normal operation of the pumping unit 10.

From the foregoing, it will be apparent that the present invention brings to the art a new and improved fuel pumping unit 10 in which a regulating valve 27 operates independently of the inlet pressure and is capable of compensating for a buildup of discharge pressure resulting from the pumping unit having to pump fuel upwardly to a burner. The regulating valve monitors the discharge pressure at the nozzle port 14 downstream of the metering orifice 50 and adjusts the pressure upstream of the metering orifice to maintain a constant pressure differential across the orifice. As a result, the volumetric flow rate of fuel delivered to the burner is independent of the relative elevations between the burner, the tank 11, and the pumping unit. Moreover, the pumping unit includes a check valve 53 which maintains a relatively high pressure at the nozzle port 14 so long as the shutoff valve on the burner is closed. When the shutoff valve is opened, the nozzle receives a short burst of relatively high pressure fuel to the nozzle just prior to ignition of the burner.

We claim:

1. A fuel supply unit for an oil burner having a nozzle, said fuel supply unit comprising a pump having an intake line adapted to communicate with a fuel storage tank and having a reservoir for receiving fuel from said storage tank, said pump having outlet means and being operable to pressurize fuel from said reservoir and to deliver pressurized fuel to said outlet means, discharge passage means for delivering fuel to said burner, a metering orifice establishing communication between said outlet means and said discharge passage means whereby the volumetric flow rate of fuel deliverable to the burner is related to the differential between the pressure of the fuel in said outlet means and the pressure of the fuel in said discharge passage means, and means for regulating the pressure in said outlet means, said means for regulating being responsive to the pressure in said discharge passage means so as to adjust the pressure of the fuel in said outlet means and to maintain a predetermined relationship between the pressure in said outlet means and the pressure in said discharge passage means.

2. A fuel supply unit as defined in claim 1 in which said regulating means maintains a relatively constant differential between the pressure of the fuel in said outlet means and the pressure of the fuel in said discharge passage means whereby the volumetric flow rate of fuel delivered to the burner is relatively independent of the pressure of the fuel in said discharge passage means.

3. A fuel supply unit as defined in claim 1 in which said regulating means comprise a control chamber communicating with said outlet means, a port for venting fuel from said control chamber, a valve member movably disposed with respect to said port and operable to modulate the flow area at said port, said valve member having first and second projected areas, the pressure in said control chamber acting on said first projected area in a direction to cause said valve member to establish communication between said control chamber and said port, a reference chamber communicating with said discharge passage means, the pressure in said reference chamber acting on said second projected area in a direction opposing the force of the pressure in said control chamber, and a spring acting on said valve member in a direction opposing the force of the pressure in said control chamber whereby said valve member modulates the flow area at said port until the force of the pressure in said control chamber balances the combined opposing forces of said spring and the pressure in said reference chamber.

4. A fuel supply unit as recited in claim 3 in which said first and said second projected areas are approximately equal in size whereby a change in the pressure of the fuel in said reference chamber results in an approximately equal change in the pressure of the fuel in said control chamber.

5. A fuel supply unit as defined in claim 3 further comprising return passage means between said port and said reservoir for returning the fuel vented from said control chamber to said reservoir.

6. A fuel supply unit as defined in claim 1 further comprising valve means responsive to the pressure in said outlet chamber and operable to vent fuel and air from said outlet chamber until the pressure in said outlet chamber reaches a predetermined value.

7. A fuel supply unit as defined in claim 1 and adapted to provide the burner with a short burst of relatively high pressure fuel for cleaning the nozzle in the burner each time an inlet shutoff valve on the burner is opened, said fuel supply unit further comprising bypass passage means communicating with the storage tank, and a check valve between said discharge passage means and said bypass passage means, said check valve normally preventing communication between said discharge passage means and said bypass passage means when the shutoff valve is open and the pressure in said discharge passage means is below a maximum normal operating pressure, said check valve selectively establishing one way communication from said discharge passage means to said bypass passage means for venting fuel from said discharge passage means when the shutoff valve is closed and the pressure in said discharge passage means approaches a predetermined maximum pressure above the maximum normal operating pressure, said check valve maintaining the pressure in said discharge passage means near the predetermined maximum pressure so long as the shutoff valve is closed.

8. A fuel supply unit for an oil burner having a nozzle and having a shutoff valve to control the flow of fuel to the nozzle, said fuel supply unit comprising a reservoir adapted to communicate with a fuel storage tank for receiving fuel from said storage tank, a pump having relatively rotatable inner and outer gear pumping elements, said pump having inlet passage means communicating with said reservoir and having an outlet chamber, a shaft rotatably coupled with one of said pumping elements for driving said pumping elements, said pumping elements being operable to draw fuel from said reservoir by way of said inlet passage means and to deliver pressurized fuel to said outlet chamber, discharge passage means for delivering fuel to said burner, a metering orifice formed in said outer pumping element, said metering orifice intermittently establishing communication between said outlet chamber and said discharge passage means as said outer pumping element rotates, means for maintaining the pressure in said discharge passage means at a relatively high pressure when the shutoff valve is closed, said relatively high pressure being above a maximum normal discharge pressure, said relatively high pressure providing a short burst of fuel when the shutoff valve is opened to enable cleaning of the nozzle, and means for regulating the pressure in said outlet chamber, said regulating means being responsive to the pressure in said discharge passage means so as to maintain a relatively constant pressure differential between said outlet chamber and said discharge passage means whereby the volumetric flow rate of fuel delivered to the burner is independent of the pressure of the fuel in said discharge passage means.

* * * * *